United States Patent [19]

Tomkins et al.

[11] Patent Number: 5,028,257

[45] Date of Patent: Jul. 2, 1991

[54] METALLURGICAL FLUX COMPOSITIONS

[75] Inventors: Andrew J. Tomkins, Sutton Coldfield, United Kingdom; Royston J. Phillips, Strongsville, Ohio

[73] Assignee: Foseco International Limited, England

[21] Appl. No.: 513,860

[22] Filed: Apr. 24, 1990

[30] Foreign Application Priority Data

Mar. 10, 1990 [GB] United Kingdom ..... 9005431

[51] Int. Cl.[5] ..... C22B 9/10

[52] U.S. Cl. ..... 75/305; 75/329; 106/38.27; 106/38.28; 164/473

[58] Field of Search ..... 75/329, 327, 305; 164/473; 106/38.27, 38.28

[56] References Cited

U.S. PATENT DOCUMENTS 4,102,690 7/1978 Koper ..... 75/305
4,417,924 11/1983 Schwer ..... 75/329

FOREIGN PATENT DOCUMENTS 2354560 10/1972 Fed. Rep. of Germany .
47-50967 12/1972 Japan .
9099931 9/1974 Japan .
0022715 3/1975 Japan .
0028459 3/1975 Japan .
0090528 7/1975 Japan .
0143727 11/1975 Japan .
1093728 8/1976 Japan .
6030533 9/1976 Japan .
0258406 12/1985 Japan .
60-258406 12/1985 Japan .
1127809 6/1986 Japan .
1449234 9/1976 United Kingdom .

*Primary Examiner*—Melvin J. Andrews
*Attorney, Agent, or Firm*—Nixon & Vanderhye

[57] ABSTRACT

A metallurgical flux composition comprising calcium oxide, alumina, magnesium oxide and silica contains 22–35% by weight magnesium oxide and has a weight ratio of calcium oxide to magnesium oxide of from 0.6:1 to 2.5:1. The preferred composition contains 28–42% by weight calcium oxide, 13–21% by weight alumina, 22–35% by weight magnesium oxide and 3–8% by weight silica, preferably has a calcium oxide to magnesium oxide weight ratio of from 0.8:1 to 1.9:1 and preferably has a calcium oxide to silica weight ratio of from 6.0:1 to 7.5:1. The flux composition is particularly useful as a tundish cover in the continuous casting of steel.

4 Claims, No Drawings

METALLURGICAL FLUX COMPOSITIONS

This invention relates to metallurgical flux compositions, and particularly to flux compositions which are used to cover molten steel in tundishes in the continuous casting of steel.

In the continuous casting of steel a tundish is used as an intermediate vessel between a ladle and a mould to provide a reservoir of molten metal, and to distribute the molten steel to the mould. In recent times steelmakers have investigated the tundish not only as a reservoir provider and distributor but also as a vessel in which nonmetallic oxide inclusions such as deoxidation products (for example solid alumina and liquid calcium aluminates) and slag carried over from the ladle can be removed from the molten steel.

It is normal practice to use calcined rice hulls or other inert powders to cover the molten steel in the tundish during the casting operation. However although rice hulls and similar materials provide excellent thermal insulation they do not prevent aluminium reoxidation or nitrogen contamination, nor provide a means for removing non-metallic inclusions contained in the steel.

Consequently in order to achieve the aim of producing "clean" steel in the tundish steelmakers have started to use flux compositions containing components such as silica, calcium oxide, alumina, magnesium oxide and calcium fluoride as tundish covers. For example Japanese Unexamined Patent Publication No. 60-258406 describes the use as a tundish cover of a flux composition containing 3% by weight carbon, 5–15% by weight silica, 5–20% by weight alumina, 30–60% by weight calcium oxide, 5–20% magnesium oxide and 10–40% by weight calcium fluoride.

However such flux compositions, although capable of removing non-metallic inclusions and producing clean steel, suffer from the major disadvantage that they can attack and destroy the refractory material with which the tundish is lined.

It has now been found that the above disadvantage can be overcome using a flux composition which contains more magnesium oxide than has hitherto been used, and in which the calcium oxide and magnesium oxide are present in a weight ratio of calcium oxide to magnesium oxide of from 0.6:1 to 2.5:1.

According to the present invention there is provided a flux composition comprising calcium oxide, alumina, magnesium oxide and silica wherein the magnesium oxide content is 22–35% by weight and the weight ratio of calcium oxide to magnesium oxide is from 0.6:1 to 2.5:1.

The preferred flux composition contains 28–42% by weight calcium oxide, 13–21% by weight alumina, 22–35% by weight magnesium oxide and 3–8% by weight silica, preferably has a calcium oxide to magnesium oxide weight ratio of from 0.8:1 to 1.9:1 and preferably has a calcium oxide to silica weight ratio of from 6.0:1 to 7.5:1.

If desired the flux composition of the invention may also contain a proportion of carbon, such as graphite, usually in an amount of 3–8% by weight. Graphite improves the flowability of the flux composition, improves its thermal insulation properties, and helps to prevent the composition from sintering and crusting when applied to the surface of molten steel.

The calcium oxide content of the flux composition may be provided by the use of materials such as lime chippings, limestone or calcined dolomitic lime, and the magnesium oxide content may be provided by materials such as dead burnt magnesite or calcined dolomitic lime. The alumina which is included as a fluxing agent to lower the melting point of the flux composition is preferably added in the form of calcined alumina or perlite. As perlite has a relatively low density compared with the other raw materials used to produce the flux composition it has the effect of reducing the overall density of the composition and improving the thermal insulation properties of the composition in use. Perlite will also provide or contribute to the silica content of the composition. Some silica is also present in dead burnt magnesite.

The flux composition may also contain minor amounts of impurities, such as sodium oxide and iron oxide, which are present in the raw materials used to produce the flux.

The flux composition is applied to the surface of molten steel contained in a tundish at the beginning of the casting operation, usually at the rate of about 0.8 to 1.2 lb per ton of steel cast. During casting, as subsequent heats of steel are cast, further amounts of the flux should be added at lower addition rates.

The flux composition of the invention have the following properties and advantages:

1) Good flowability with minimum dusting when applied to the surface of the molten steel.

2) No flame production except in the case of compositions containing carbon which produce small blue flames.

3) No crust formation on the molten steel surface providing an adequate depth of insulating cover is maintained.

4) Good ability to absorb non-metallic alumina and calcium aluminate inclusions floating out of the steel.

5) Compatibility with basic tundish lining systems and with refractory tundish components such as weirs and shrouds.

6) Prevention of reoxidation by providing a chemical barrier between the steel and the atomsphere.

7) Adequate thermal insulation in most applications. Thermal insulation can be improved by the use of an insulating tundish cover in conjunction with the flux cover.

The following example will serve to illustrate the invention:

A flux composition was prepared by mixing together lime chippings (approximately 1 mm in size), dolomitic lime, limestone, calcined alumina, dead burnt magnesite, perlite and graphite so as to provide the following composition by weight:

| | |
|---|---|
| silica | 5.5% |
| calcium oxide | 37.7% |
| magnesium oxide | 25.7% |
| alumina | 17.6% |
| carbon | 7.0% |
| balance | 6.5% |

The composition had a calcium oxide to magnesium oxide weight ratio of 1.47:1 and a calcium oxide to silica weight ratio of 6.85:1.

The flux composition was used as a cover for the molten steel in a tundish used to continuously cast grade 9307 steel. The tundish was lined with GARNEX 440R refractory heat-insulating boards and contained dams and weirs made from IMPAD 44 refractory material, and had a pour box made from FOSCAST 72F cast refractory material.

A sequence of ten ladles or heats were cast through the tundish, the flux composition being added to the surface of the molten steel at one or more of three locations, denoted South, Centre and North, during the sequence. The casting time and the consumption of flux composition for each heat are tabulated in Table 1 below.

TABLE 1

| LADLE No. | CAST TIME (MIN) | PRODUCT CONSUMPTION (LB) SOUTH | CENTER | NORTH | LADLE TOTAL | CUMULATIVE TOTAL | LB/TON STEEL |
|---|---|---|---|---|---|---|---|
| 1 | 34 | 100 | 300 | 100 | 500 | 500 | 1.92 |
| 2 | 31 | 75 | 150 | 50 | 275 | 775 | 1.50 |
| 3 | 39 | 100 | 275 | 50 | 425 | 1200 | 1.53 |
| 4 | 41 | 25 | 275 | 25 | 325 | 1525 | 1.47 |
| 5 | 47 | 25 | 125 | — | 150 | 1675 | 1.29 |
| 6 | 46 | 25 | 225 | 50 | 300 | 1975 | 1.27 |
| 7 | 45 | 75 | 175 | 25 | 275 | 2250 | 1.24 |
| 8 | 55 | 50 | 150 | 100 | 300 | 2550 | 1.23 |
| 9 | 46 | 25 | 100 | 25 | 150 | 2700 | 1.15 |
| 10 | 47 | — | 100 | — | 100 | 2800 | 1.08 |

At the end of each heat samples of the slag in contact with the surface of the molten steel were taken from the pour box area and from the area over the tundish nozzle. The chemical analysis of these samples is shown in Tables 2 and 3 below.

TABLE 2

COMPOSITIONS OF SLAG TAKEN FROM THE POUR BOX AREA

| | Ladle No. 1 | 2 | 3 | 4 | 5 | 6 | 7 | 8 | 9 | 10 |
|---|---|---|---|---|---|---|---|---|---|---|
| CaO | 33.1 | 32.9 | 35.4 | 36.1 | 34.5 | 33.8 | 38.4 | 40.7 | 35.0 | 36.4 |
| $SiO_2$ | 6.0 | 6.2 | 6.7 | 7.4 | 7.8 | 7.0 | 7.0 | 5.5 | 4.2 | 4.7 |
| $Al_2O_3$ | 33.4 | 32.2 | 25.6 | 25.3 | 25.4 | 27.5 | 27.2 | 21.8 | 33.9 | 31.5 |
| MgO | 24.1 | 24.1 | 25.4 | 25.7 | 25.3 | 24.6 | 23.3 | 28.6 | 19.7 | 21.3 |
| $Fe_2O_3$ | 2.3 | 2.5 | 2.8 | 1.4 | 1.0 | 0.8 | 0.7 | 1.3 | 0.8 | 0.8 |
| MnO | 0.7 | 1.3 | 0.3 | 0.2 | 0.3 | 0.2 | 0.1 | 0.1 | 0.1 | 0.1 |
| $ZrO_2$ | 0.1 | 0.6 | 2.7 | 4.1 | 6.0 | 6.5 | 3.4 | 0.7 | 6.5 | 6.6 |
| $CaO/SiO_2$ | 5.5 | 5.3 | 5.3 | 4.9 | 4.4 | 4.8 | 5.5 | 7.4 | 8.3 | 7.7 |
| CaO/MgO | 1.37 | 1.37 | 1.39 | 1.40 | 1.36 | 1.37 | 1.64 | 1.42 | 1.78 | 1.70 |

TABLE 3

COMPOSITION OF SLAG TAKEN FROM AREA OVER NOZZLE

| | Ladle No. 1 | 2 | 3 | 4 | 5 | 6 | 7 | 8 | 9 | 10 |
|---|---|---|---|---|---|---|---|---|---|---|
| CaO | 36.1 | 42.6 | 41.6 | — | 42.0 | 36.5 | 41.2 | 38.0 | 36.6 | 40.5 |
| $SiO_2$ | 5.9 | 5.2 | 5.5 | — | 5.6 | 6.7 | 5.9 | 8.0 | 7.6 | 6.8 |
| $Al_2O_3$ | 28.4 | 20.2 | 22.1 | — | 19.6 | 26.4 | 21.3 | 23.7 | 23.4 | 23.6 |
| MgO | 28.5 | 30.9 | 28.9 | — | 31.4 | 26.1 | 30.8 | 27.8 | 29.0 | 28.1 |
| $Fe_2O_3$ | 1.5 | 1.1 | 1.0 | — | 0.8 | 0.8 | 0.8 | 2.6 | 3.0 | 1.3 |
| MnO | <0.1 | <0.1 | 0.1 | — | <0.1 | 0.1 | 0.1 | 1.0 | 1.3 | 0.6 |
| $ZrO_2$ | <0.1 | 0.2 | <0.1 | — | <0.1 | 4.2 | 0.1 | 0.4 | 0.2 | 0.1 |
| $CaO/SiO_2$ | 6.1 | 8.2 | 7.6 | — | 7.5 | 5.4 | 7.0 | 4.8 | 4.8 | 5.0 |
| CaO/MgO | 1.27 | 1.38 | 1.43 | — | 1.33 | 1.40 | 1.34 | 1.37 | 1.26 | 1.44 |

The increase in alumina of the slag samples compared to that of the flux composition and the presence of zirconia indicate that the flux cover has performed its prime function of removing alumina and other non-metallic inclusions from the molten steel. The increased ratio of calcium oxide to magnesium oxide for the samples taken from the pour box area at the end of casting ladles 7, 8 and 10 indicates that slag has been carried over from the ladle into the tundish.

During the sequence the flux composition was found to have good flowability and thermal insulation properties; it emitted little flame or dust, and did not sinter. The flux composition also caused very little erosion of the tundish lining boards and weirs.

We claim:

1. A flux composition for use in covering molten steel in a tundish comprising 28–42% by weight calcium oxide, 13–21% by weight alumina, 22–35% by weight magnesium oxide and 3–8% by weight silica.

2. A flux composition according to claim 1 wherein the weight ratio of calcium oxide to silica is from 6.0:1 to 7.5:1.

3. A flux composition according to claim 1 containing in addition a proportion of graphite.

4. A flux composition according to claim 3 wherein the graphite content is 3–8% by weight.

* * * * *